US005649715A

United States Patent [19]

Mitchell

[11] Patent Number: 5,649,715

[45] Date of Patent: Jul. 22, 1997

[54] SKATE BRAKE AND METHODS FOR ITS USE

[75] Inventor: David N. Mitchell, Englewood, Colo.

[73] Assignee: Out of Line Sports, Inc., Englewood, Colo.

[21] Appl. No.: 571,795

[22] Filed: Dec. 13, 1995

[51] Int. Cl.[6] ..... A63C 17/14

[52] U.S. Cl. ..... 280/11.2; 280/11.22

[58] Field of Search ..... 280/11.2, 11.22, 280/11.19, 82.041, 82.042; 188/2 R, 5

[56] References Cited

U.S. PATENT DOCUMENTS

| | | | |
|---|---|---|---|
| 1,524,286 | 1/1925 | Bried . | |
| 4,167,225 | 9/1979 | Fragoso | 188/5 |
| 4,275,895 | 6/1981 | Edwards | 280/11.2 |
| 5,067,736 | 11/1991 | Olson et al. | 280/11.2 |
| 5,211,409 | 5/1993 | Mitchell et al. . | |
| 5,253,882 | 10/1993 | Mitchell . | |
| 5,299,815 | 4/1994 | Brosnan et al. . | |
| 5,316,325 | 5/1994 | Mitchell et al. . | |
| 5,330,207 | 7/1994 | Mitchell . | |
| 5,465,984 | 11/1995 | Pellegrini et al. | 280/11.2 |
| 5,486,012 | 1/1996 | Olivieri | 280/11.2 |

FOREIGN PATENT DOCUMENTS

WO93/14841 8/1993 WIPO .

OTHER PUBLICATIONS

Transcript of the Deposition of David N. Mitchell, Sr., pp. 94–125.

Transcript of the Deposition of Ivan Histand, pp. 36–46.

Transcript of the Oct. 10, 1994, Hearing In Out of Line Sports, Inc. v. Rollerblade, Inc., Civil Action No. 94–Z–1284, District of Colorado.

*Primary Examiner*—Eric D. Culbreth

*Attorney, Agent, or Firm*—Townsend and Townsend and Crew LLP

[57] ABSTRACT

The invention provides a braking system and methods for slowing or stopping a roller skate. The braking system includes a male member which is attached to a back end of the roller skate's frame. A female member is slidably engaged with the male member such that the female member may be translated both toward and away from a skating surface. The female member may also be pivoted within a vertical plane which passes through a longitudinal axis of the frame during translation. A brake pad is attached to the female member, and a mechanism is provided for translating the female member relative to the male member so as to engage the brake pad with the skating surface.

20 Claims, 6 Drawing Sheets

SKATE BRAKE AND METHODS FOR ITS USE

BACKGROUND OF THE INVENTION

This invention relates generally to the field of roller skates. More particularly, this invention relates to a roller skate brake which slows or stops the skate by frictional engagement with the ground.

Traditional roller skates, having sets of wheels in tandem, have long been used in the relatively controlled environment of a skating rink. In a skating rink, the skating surface is typically flat and smooth, and skaters travel in the same direction around an oval or circular track. Hence, there are few unexpected hazards. Therefore, there has been little need for an effective brake on a traditional roller skate.

Recently, however, a faster and more maneuverable type of roller skate has been introduced. Such skates, known as "inline" skates, have wheels mounted in line rather than in tandem and function similar to an ice skate. Inline skates are offered in the United States by several vendors, including Roller Blade, Veraflex, Bauer, and California Pro. Inline skates have appealed to the athletic adult and young adult, and to persons who enjoy the outdoors. Such skates are commonly used outside, on uneven sidewalks, bicycle paths, and roads. One appealing feature of inline skates is that high speeds can be achieved. However, this may become hazardous to the skater and others when skating more rapidly than conditions allow. Hence, a variety of brakes for inline skates have been proposed.

One proposed brake for inline skates involves a fixed friction pad that extends behind the heel of the skate. The fixed friction pad is disposed above the skating surface and is made to swing down towards the skating surface by the skaters pivoting the skate about the axis of the rear wheel. As the skater raises the toe of the skate and rotates the heel downward, the friction pad behind the heel will contact the ground and stop the skate. Such systems have also been used on tandem wheeled skates which may also include (because the speeds are not so high with tandem wheeled skates) a fixed friction pad that extends in front of the toe of the skate. In this case, the skater brings the friction pad to bear on the skating surface by raising the heel and lowering the toe. Such brakes which require either the toe to be raised or lowered suffer from a number of serious drawbacks including skater fatigue in operating the brake and difficulty in maneuvering the skate to engage the brake with the skating surface.

One particularly useful type of brake which does not require the toe to be raised or lowered is a mechanically activated brake which engages the ground to slow or stop the brake as described in U.S. Pat. Nos. 5,211,409; 5,253,882; 5,316,325; and 5,330,207, the complete disclosures of which are herein incorporated by reference. Such a brake system includes a carriage that pivots about the rear of a skate so as to bring the brake pad into contact with the skating surface when activated by a hand-activated actuator. In this way, the skater need not perform any special body movement to raise or lower the toe of the skate.

Although such brakes which include a pivoting carriage have proven to be generally effective in slowing or stopping a skater, certain improvements are desired. For example, it would be desirable if the number of moving parts could be kept to a minimum so that manufacturing costs can be reduced and so that the life and reliability of the brake may be improved.

Hence, for these and other reasons it would be desirable to provide an improved skate braking system which will slow or stop a skater by engaging a brake pad with the ground. Among other advantages, such a braking system should be relatively easy to manufacture and should have a minimum of moving parts so that manufacturing costs can be decreased and the life and reliability of the skate may be improved.

SUMMARY OF THE INVENTION

The invention provides systems and methods for slowing or stopping a roller skate with a brake pad that engages the ground without requiring the toe of the skate to be raised or lowered. Although the braking system and methods may be used with virtually any type of roller skate, they will find their greatest use with "inline" skates. The braking system of the invention may be integrally formed with a roller skate, or can alternatively be constructed to be a retrofit for an existing skate.

In an exemplary embodiment, the braking system is used with a roller skate having a frame with a longitudinal axis and a boot which is attached to the frame. A male member is attached to a back end of the roller skate, preferably to a back end of the frame, and a female member is slidably engaged with the male member. The female member is slidably engaged with the male member such that the female member may be translated both toward and away from the skating surface as well as pivoting within a vertical plane which passes through the longitudinal axis during translation. A brake pad is attached to the female member, and a means is provided for translating the female member relative to the male member so as to engage the brake pad with the skating surface.

In one preferable aspect, the male member is rigidly attached to the back end of the roller skate, such as to the back end of the frame or the boot, so that it will not move relative to the frame. For example, the male member may be rigidly attached to the frame by a yoke. In this manner, the yoke may be placed over the back wheel to place the male member at the back end of the skate. Alternatively, the male member may be directly attached to, or integrally formed with, the frame or the boot. In still another aspect, the male member comprises at least one engaging element and at least one extension element, and the female member includes at least one elongate slot which is keyed to receive the engaging element. Preferably, the engaging element comprises a sphere and the connecting element comprises a shaft. The keyed slot will preferably at least partially encompass the sphere to prevent detachment of the sphere from the slot when the brake pad engages the skating surface while still allowing the female member to pivot within the vertical plane.

In one exemplary aspect, the boot includes a cuff which may be pivoted in the vertical plane. The proximal end of the female member is pivotally attached to the cuff by a pivot pin so that when the skater pivots the cuff, the female member is translated in the vertical plane to engage the braking pad with the skating surface. To release the brake, the skater simply pivots the cuff in the opposite direction.

The invention also provides an exemplary method for slowing or stopping a roller skate. According to the method, the roller skate is provided with a male member and a female member which is slidably engaged with the male member such that the female member may be translated both toward and away from a skating surface. The female member may also pivot within a vertical plane which passes through a longitudinal axis of the roller skate during translation. To slow or stop the roller skate, the female member is translated toward the skating surface while pivoting the female member within the vertical plane until a brake pad on the female member engages the skating surface.

After the roller skate has been stopped or slowed to the desired speed, the female member is translated away from the skating surface until the brake pad disengages the skating surface. Preferably, the male member comprises a spherical element and the female member includes a keyed slot which receives the spherical element. In this manner, the female member is translated by sliding and pivoting the spherical element along the keyed slot. In another aspect, the boot includes a cuff which may pivot in the vertical plane. The female member is attached to the cuff so that as the cuff is pivoted, the female member will be translated to move the braking pad toward or away from the skating surface.

DETAILED DESCRIPTION OF THE SPECIFIC EMBODIMENTS

Figure 1:
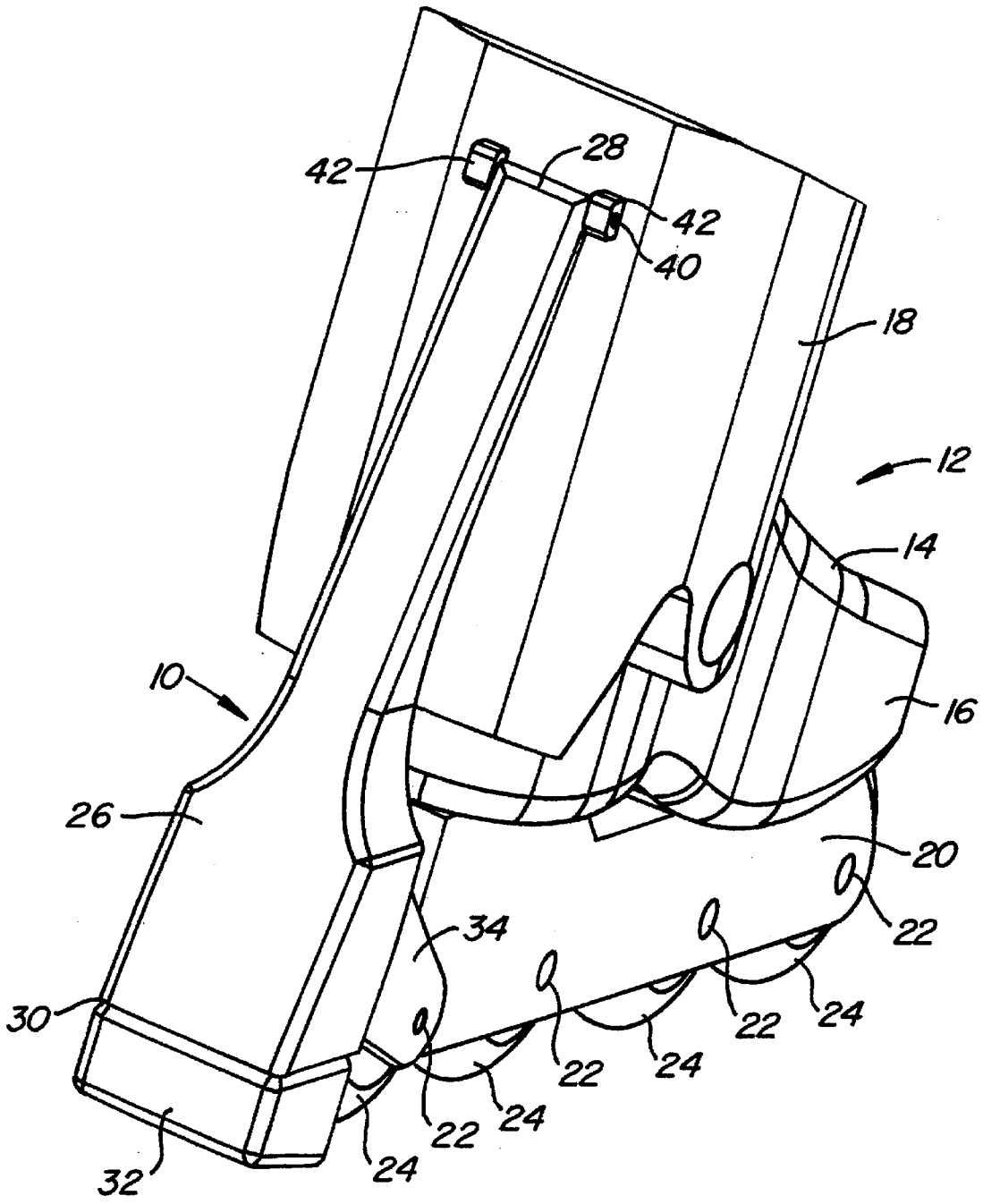
FIG. 1 is a perspective view of a back end of a roller skate having a braking system according to the present invention.

Referring to FIG. 1, an exemplary braking system 10 for a roller skate 12 will be described. Roller skate 12 is an "inline" type of skate and includes a boot 14 having a foot portion 16 and a cuff 18. Foot portion 16 is securely attached (or integrally formed with) a frame 20. Attached to frame 20 by axles 22 are a plurality of wheels 24. Frame 20 holds wheels 24 "in line" or in a vertical plane, i.e., a plane normal to axles 22.

Braking system 10 includes a female member 26 having a proximal end 28 and a distal end 30. Attached to distal end 30 is a braking pad 32. Braking system 10 further includes a male member 34 which is rigidly, i.e. non-pivotally, attached to frame 20 at axle 22.

Figure 2:
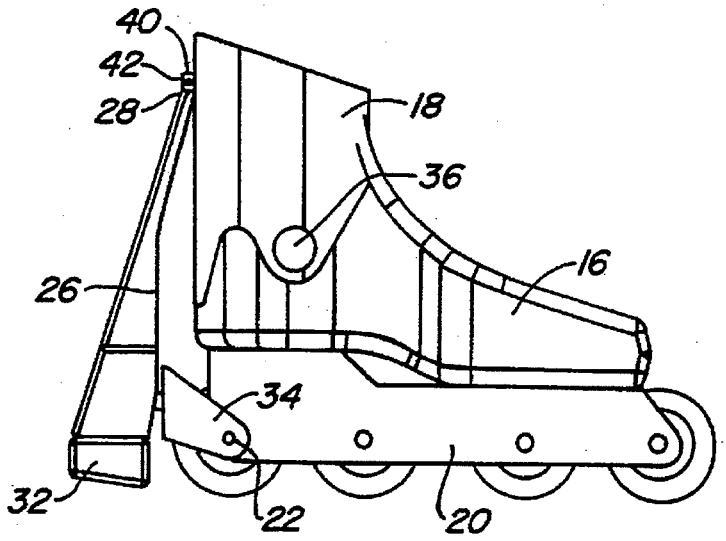
FIG. 2 is a side view of the roller skate and braking system of FIG. 1.
Figure 3:
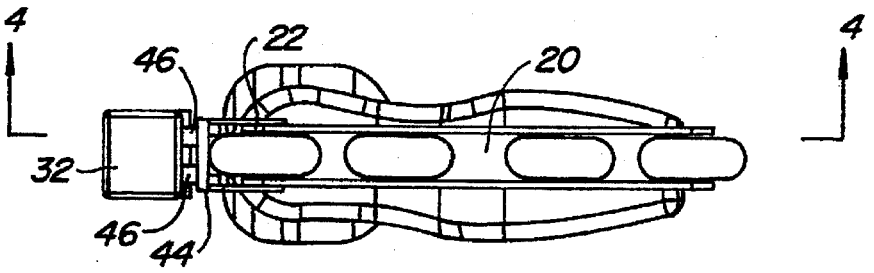
FIG. 3 is a bottom view of the roller skate and braking system of FIG. 2.
Figure 4:
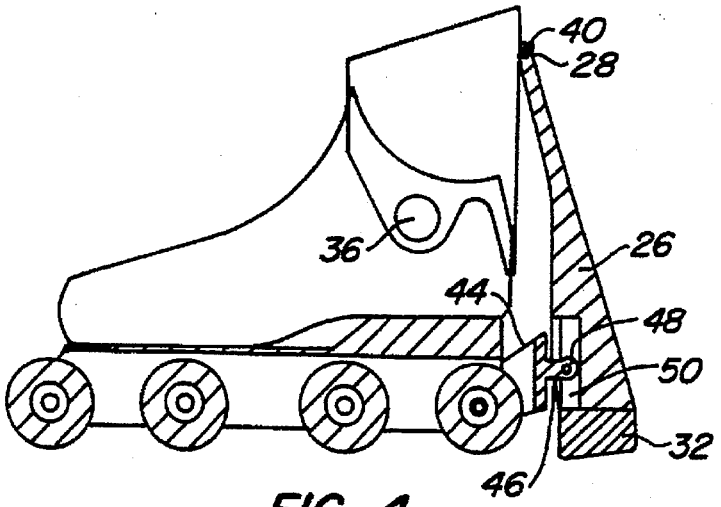
FIG. 4 is a cross-sectional side view of the roller skate and braking system of FIG. 3 taken along lines 4—4.
Figure 6:
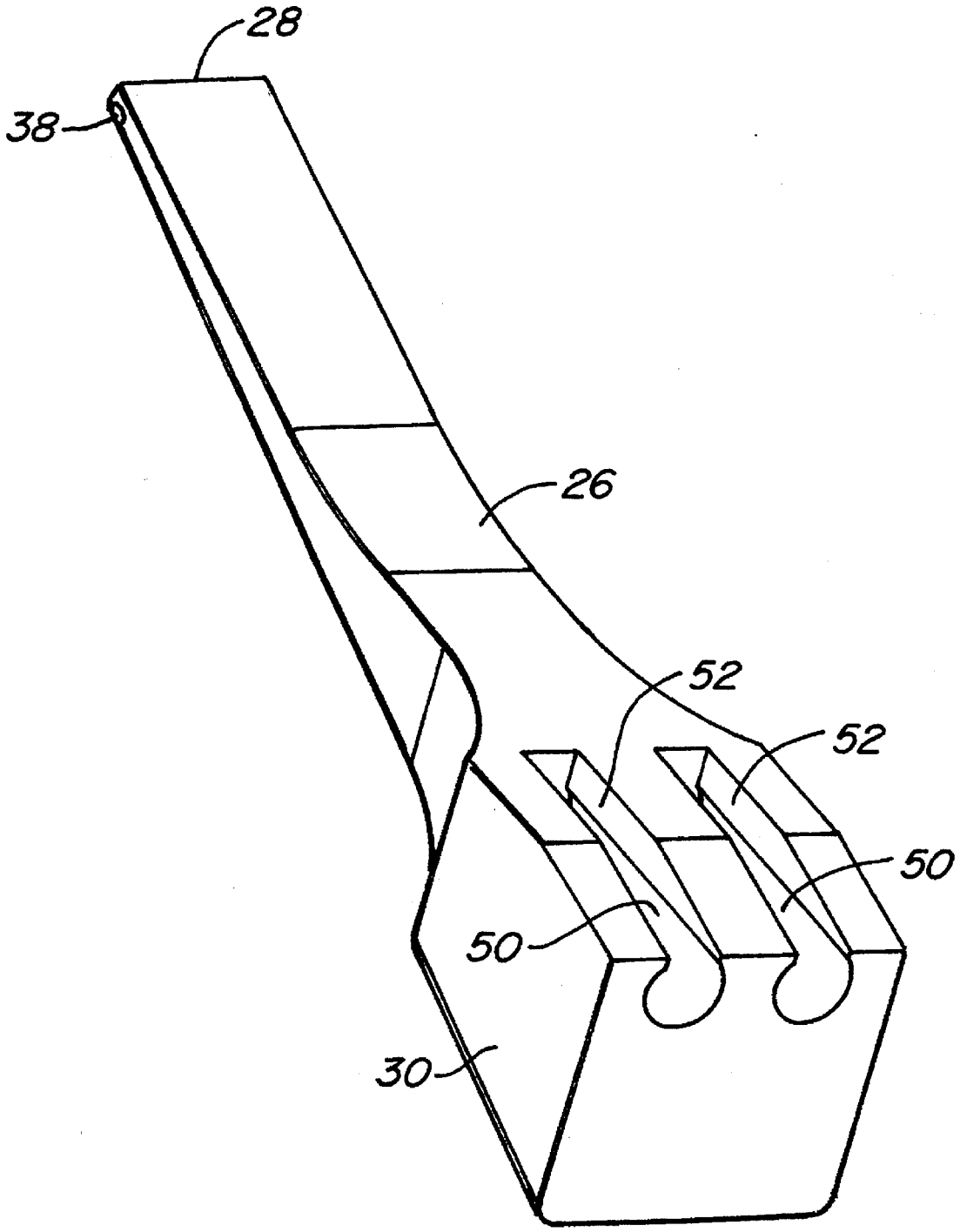
FIG. 6 is a perspective view of an exemplary female member of the braking system of FIG. 1 which may be slidably engaged with the male member of FIG. 5 according to the present invention.

Referring to FIGS. 2–4, operation of braking system 10 to slow or stop roller skate 12 will be described in greater detail. Cuff 18 is pivotally attached to foot portion 16 by a pin 36 which allows cuff 18 to pivot relative to foot portion 16 and frame 20. Cuff 18 pivots in the vertical plane, i.e., a plane normal to axles 22, which preferably contains wheels 24. As best shown in FIG. 6, female member 26 includes an elongate channel 38 extending through proximal end 28. As shown in FIGS. 2 and 4, proximal end 28 of female member 26 is pivotally attached to cuff 18 by a pin 40 extending through channel 38 and which is connected to a pair of tabs 42 (see FIG. 1) on cuff 18. In this manner, as cuff 18 is pivoted about pin 36, proximal end 28 of female member 26 is translated in a vertical plane, with its path of travel being about an arc defined by pin 36.

Figure 5:
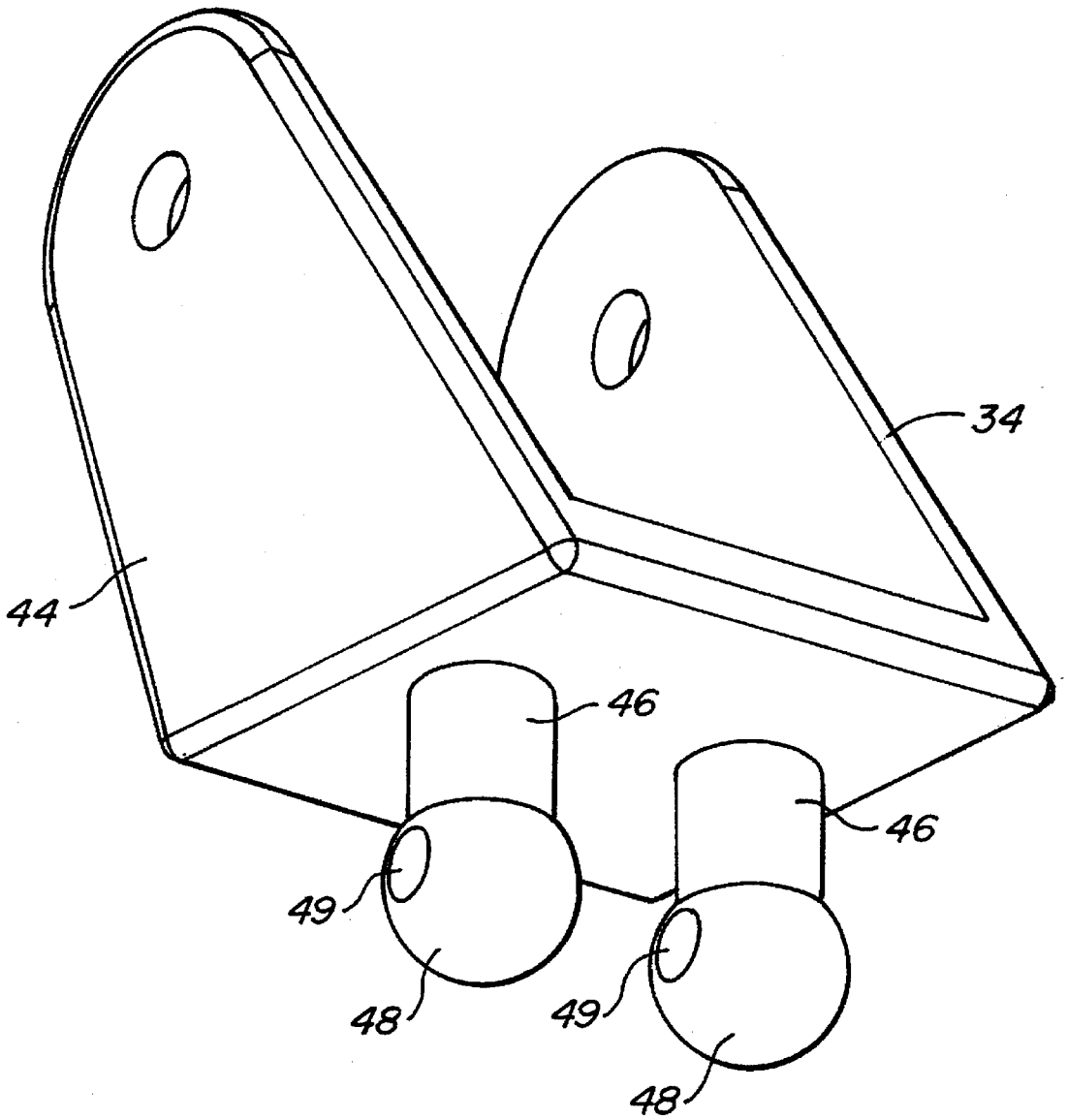
FIG. 5 is a perspective view of an exemplary male member of the braking system of FIG. 1.

As best shown in FIG. 5, male member 34 includes a yoke 44, a pair of spherical elements 46, and a pair of shafts 48 connecting the spherical elements 46 to yoke 44. Referring back to FIG. 3, yoke 44 is rigidly, i.e. non-pivotally, attached to frame 20 at the back axle 22. Yoke 44 allows spherical elements 46 to be positioned at a back end of roller skate 12 and serves in part to guide the travel of distal end 30 of female member 26. Yoke 44 positions shafts 48 parallel to the vertical plane so that travel of the female member 26 will also be within the vertical plane upon actuation by cuff 18.

As best shown in FIGS. 4 and 6, female member 26 includes a pair of keyed slots 50 at distal end 30 into which spherical elements 48 and a portion of shafts 46 are received. As female member 26 is translated within the vertical plane, spherical elements 48 slide within slots 50, causing braking pad 32 to move either generally toward or away from a skating surface. Spherical elements 46 may optionally have a pair of flat faces 49 to assist elements 46 in sliding within keyed slots 50.

Since proximal end 28 will be rotated about an arc defined by pin 36, female member 26 will pivot somewhat about spherical elements 48. The generally spherical geometry of elements 48 facilitates such pivoting to make translation of female member 26 easier and to prevent damage to the component parts of the braking system.

When braking pad 32 engages the skating surface, a significant horizontal force will be exerted on female member 26. Keyed slots 50 are instrumental in holding female member 26 to male member 34 during braking. Specifically, pairs of narrowed walls 52 (see FIG. 6) of keyed slots 50 prevent spherical elements 48 from being pulled horizontally from keyed slots 50.

Hence, by constructing braking system 10 and roller skate 12 as previously described, a skater may slow or stop roller skate 12 by straightening his or her legs causing cuff 18 to pivot about pin 36 in a counterclockwise direction. As cuff 18 pivots, proximal end 28 of female member 26 is also pivoted in a counterclockwise direction about pin 36. In turn, distal end 30 is translated toward the skating surface with spherical elements 48 translating through and pivoting within keyed slots 50 until brake pad 32 engages the skating surface. After the skater has slowed the desired amount or stopped, the legs are bent to pivot cuff 18 about pin 36 toward the front of the skate, i.e. clockwise about pin 36. In turn, female member 26 is translated to lift braking pad 32 from the skating surface.

Configuration of braking system 10 in this manner is advantageous in that skate 12 may be slowed or stopped with essentially only one moving part, i.e., female member 26. With fewer moving parts, braking system 10 is generally more durable and will have a long life. Braking system 10 is also easy to manufacture thereby reducing the overall costs to the skater.

One particular advantage of braking system 10 is that it may either be retrofit to an existing skate or may be manufactured to be an integral part of the skate. Retrofitting may easily be accomplished by attaching male member 34 to frame 20 at the back axle 22 and sliding female member 26 over spherical elements 48. As another alternative, roller skate 12 may be constructed to have a spherical member and optionally a spherical member integrally formed with frame 20 or foot portion 16 at the time of manufacture. For example, frame 20 could be extended beyond the back wheel 24 and a spherical member connected directly thereto. In this way, a yoke will not be needed.

Figure 7:
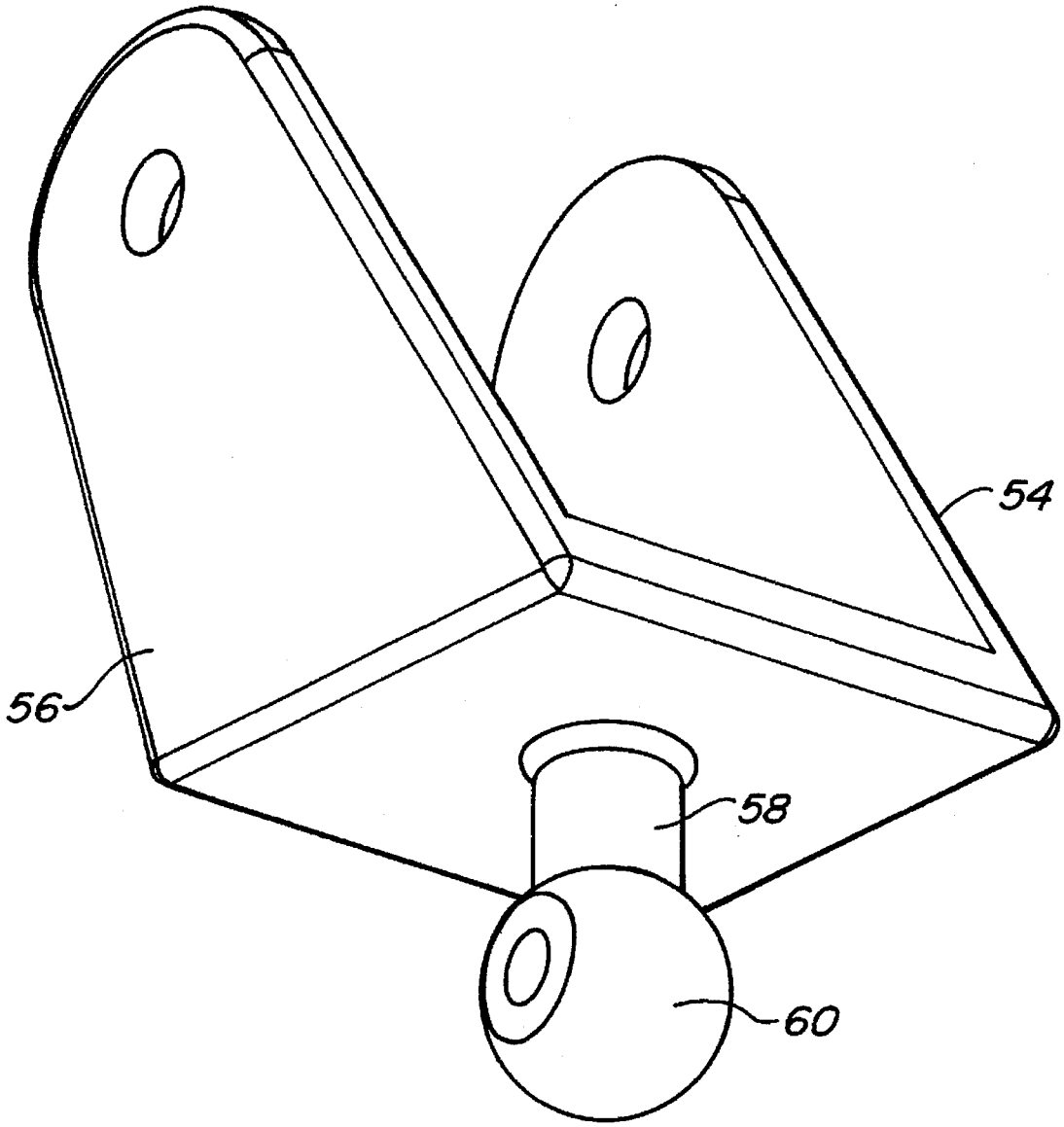
FIG. 7 is a perspective view of an alternative embodiment of a male member according to the present invention.
Figure 8:
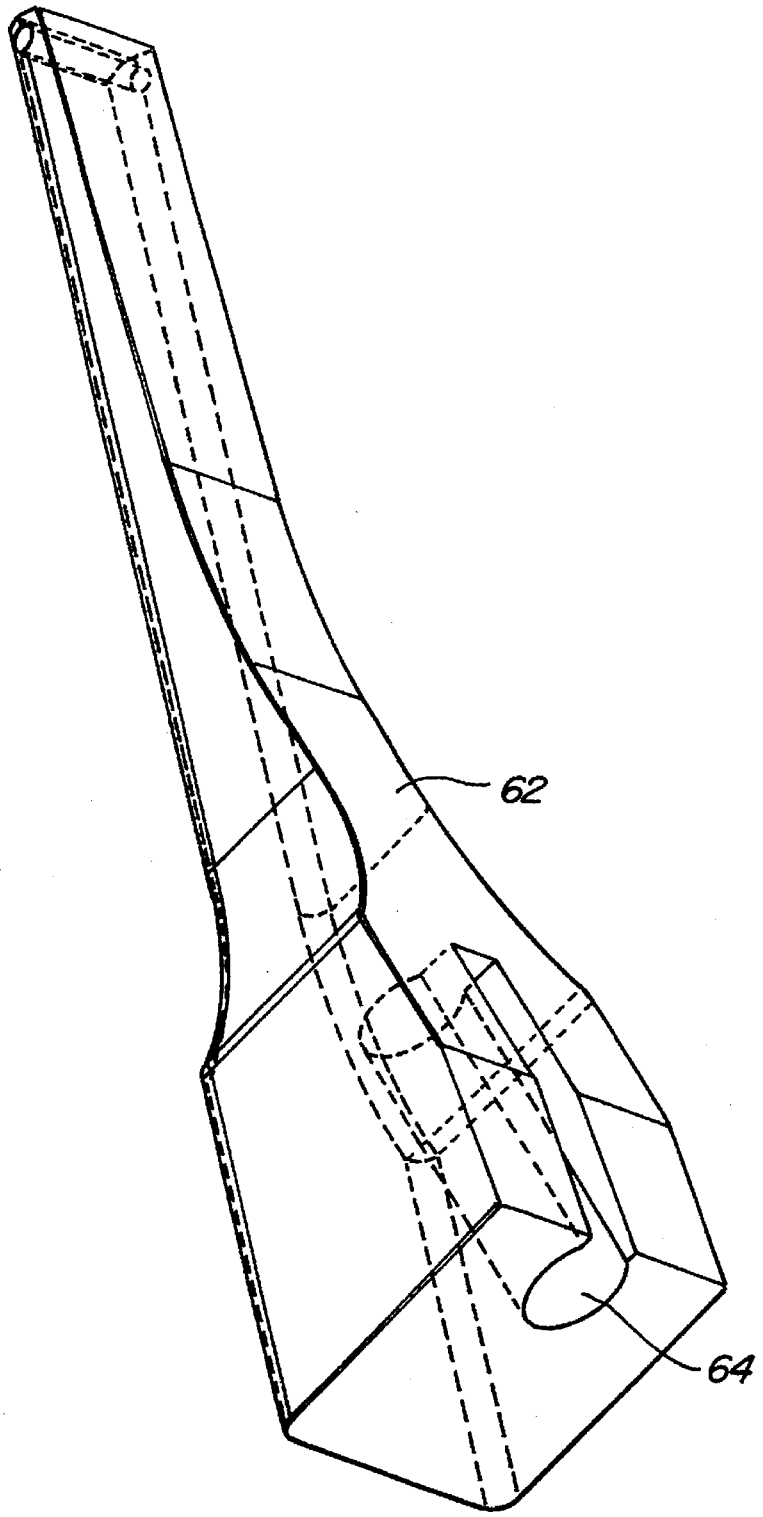
FIG. 8 is a perspective view of an alternative embodiment of a female member which may be slidably engaged with the male member of FIG. 7 according to the present invention.

Braking system 10 may be constructed to have different embodiments of female members and male members. One example of an alternative male member and female member is illustrated in FIGS. 7 and 8. In FIG. 7, a male member 54 includes a yoke 56 which is similar to yoke 44 as previously described. Male member 54 is essentially identical to male member 34 except that male member 54 includes only a single shaft 58 and spherical element 60. As shown in FIG. 8, a female member 62 is essentially identical to female member 26 as previously described except female member 62 includes only a single keyed slot 64 for receiving spherical element 60 and shaft 58. Alternatively, spherical element 60 (or elements 48) may be constructed of other geometries as long as it will both travel and pivot within a corresponding keyed slot in the female member.

Although braking system 10 is shown to be cuff actuated, other actuation mechanisms are possible. For example, female member 26 may be translated by using a cable actuator similar to the actuator described in U.S. Pat. No. 4,253,882, previously incorporated by reference. Other possible actuators include a wireless or wire actuated solenoid that will translate the female member, a hydraulic system that is hand actuated by the skater to move the female member, a bladder filled with fluid that is positioned between the shell of the boot and the skater's leg (and in communication with the female member) so that pressure by the skater's leg will cause fluid from the bladder to move the female member, and the like.

The invention has now been described in considerable detail for purposes of clarity and understanding. However, alternative embodiments of the invention will occur to those skilled in the art. Therefore, the above description should not be taken as limiting the scope of the invention. Instead, the scope of the invention should be determined chiefly with reference to the appended claims, along with the full scope of equivalents to which those claims are entitled.

What is claimed is:

1. A roller skate braking system, comprising:

a male member adapted for attachment to a back end of a roller skate;

a female member slidably engaged with the male member such that the female member may be translated both toward and away from a skating surface, and which is movable within a vertical plane which passes through a longitudinal axis of the roller skate during translation;

a brake pad attached to the female member; and means for translating the female member relative to the male member so as to engage the brake pad with the skating surface.

2. A system as in claim 1, wherein the male member is adapted to be rigidly attached to a frame of the roller skate.

3. A system as in claim 2, further comprising a yoke which is adapted to connect the male member to the frame.

4. A system as in claim 1, wherein the male member comprises at least one engaging element and at least one extension element, and wherein the female member includes at least one elongate slot which is keyed to receive the engaging element.

5. A system as in claim 4, wherein said at least one engaging element comprises a sphere and wherein the extension element comprises a shaft.

6. A system as in claim 5, wherein the keyed slot at least partially encompasses the sphere to prevent detachment of the sphere from the slot when the brake pad engages the skating surface while allowing the female member to pivot the vertical plane.

7. A system as in claim 1, wherein the female member includes a proximal end and a distal end, and wherein the proximal end includes an elongate channel to allow the female member to be pivotally connected to the boot by a pivot pin.

8. A system as in claim 7, wherein the boot includes a cuff which is pivotable in the vertical plane, wherein the proximal end of the female member is pivotally connected to the cuff, and wherein the means for translating comprises the cuff and the pivot pin, whereby movement of the cuff in the vertical plane translates the female member in the vertical plane.

9. A roller skate comprising:

a frame having a longitudinal axis;

a boot attached to the frame;

a male member attached to a back end of the frame;

a female member slidably engaged with the male member such that the female member may be translated both toward and away from a skating surface, and which is movable within a vertical plane which passes through the longitudinal axis during translation;

a brake pad attached to the female member; and means for translating the female member relative to the male member so as to engage the brake pad with the skating surface.

10. A skate as in claim 9, wherein the male member is rigidly attached to the frame.

11. A skate as in claim 10, further comprising a yoke which connects the male member to the frame.

12. A skate as in claim 9, wherein the male member comprises at least one engaging element and at least one extension element, and wherein the female member includes at least one elongate slot which is keyed to receive the engaging element.

13. A skate as in claim 12, wherein said at least one engaging element comprises a sphere and wherein the extension element comprises a shaft.

14. A skate as in claim 13, wherein the keyed slot at least partially encompasses the sphere to prevent detachment of the sphere from the slot when the brake pad engages the skating surface while allowing the female member to pivot within the vertical plane.

15. A skate as in claim 9, wherein the female member includes a proximal end and a distal end, and wherein the proximal end is pivotally connected to the boot by a pivot pin.

16. A skate as in claim 15, wherein the boot includes a cuff which is pivotable in the vertical plane, wherein the proximal end of the female member is pivotally connected to the cuff, and wherein the means for translating comprises the cuff and the pivot pin, whereby movement of the cuff in the vertical plane translates the female member in the vertical plane.

17. A method of slowing or stopping a roller skate, the method comprising:

providing the roller skate with a male member and a female member which is slidably engaged with the male member such that the female member may be translated both toward and away from a skating surface, and which is movable within a vertical plane which passes through a longitudinal axis of the roller skate during translation; and translating the female member toward the skating surface while pivoting the female member within the vertical plane until a brake pad on the female member engages the skating surface.

18. A method as in claim 17, further comprising translating the female member away from the skating surface until the brake pad disengages the skating surface and retranslating the female toward the skating surface until the brake pad engages the skating surface.

19. A method as in claim 17, wherein male member comprises a spherical element and the female member includes a keyed slot which receives the spherical element, and wherein the translating step further comprises sliding and pivoting the spherical element along the keyed slot.

20. A method as in claim 19, wherein the boot includes a cuff which is pivotable in the vertical plane, wherein the female member is pivotally attached to the cuff, and wherein the translating step further comprises pivoting the cuff within the vertical plane.

* * * * *